US010589892B2

(12) United States Patent
Van Dijk et al.

(10) Patent No.: US 10,589,892 B2
(45) Date of Patent: Mar. 17, 2020

(54) PACKET FOR FRENCH FRIES AND A PLANO FOR ASSEMBLING SUCH PACKET

(71) Applicant: Lamb-Weston/Meijer V.O.F., PJ Kruiningen (NL)

(72) Inventors: Dirk Van Dijk, HK Veghel (NL); Mike Vermeer, GR Bavel (NL)

(73) Assignee: LAMBWESTON/MEIJER VOF, PJ Kruiningen (NL)

( * ) Notice: Subject to any disclaimer, the term of this patent is extended or adjusted under 35 U.S.C. 154(b) by 0 days.

(21) Appl. No.: 15/780,851

(22) PCT Filed: Dec. 6, 2016

(86) PCT No.: PCT/NL2016/050846
§ 371 (c)(1),
(2) Date: Jun. 1, 2018

(87) PCT Pub. No.: WO2017/099587
PCT Pub. Date: Jun. 15, 2017

(65) Prior Publication Data

US 2018/0354676 A1 Dec. 13, 2018

(30) Foreign Application Priority Data

Dec. 7, 2015 (NL) ..... 2015918

(51) Int. Cl.
*B65D 5/42* (2006.01)
*B65D 5/02* (2006.01)
*B65D 85/36* (2006.01)

(52) U.S. Cl.
CPC ..... *B65D 5/4295* (2013.01); *B65D 5/0209* (2013.01); *B65D 85/36* (2013.01); *B65D 2205/02* (2013.01)

(58) Field of Classification Search
CPC ..... B65D 5/4295; B65D 5/0209; B65D 5/18; B65D 2205/02
(Continued)

(56) References Cited

U.S. PATENT DOCUMENTS 3,468,317 A * 9/1969 Rowland ..... A24F 19/0028 131/235.1
4,711,389 A * 12/1987 Alba ..... B65D 5/18 229/120
(Continued)

FOREIGN PATENT DOCUMENTS

CN 2630122 Y 8/2004
DE 202011051768 1/2013

OTHER PUBLICATIONS

International Search Report dated Jan. 26, 2017.

*Primary Examiner* — Christopher R Demeree
(74) *Attorney, Agent, or Firm* — Ryan T. Grace; Advent, LLP

(57) ABSTRACT

A packet (10) for french fries comprising a bottom (11), side walls, a front- and a back-wall (12) and a closable lid (13), which packet has a total surface area and is provided with perforations (8, 8') that collectively have an open area which is set at a preselected ratio of the total surface area, wherein said perforations are provided in the lid and in the front- and back-wall. The packet is made from a one-piece plano (1) comprising a connecting member (2) that connects on opposite sides of said member to a first and a second side member (3, 4). The first and the second side member are each tapering with an increasing width with increasing distance from the connecting member, wherein said width is measured perpendicularly to a body axis (5) extending through the first and second side member and the connecting member.

13 Claims, 6 Drawing Sheets

(58) Field of Classification Search
USPC ..... 229/107, 400, 902, 120, 126, 193, 906, 229/106, 132; D9/431; 220/838
See application file for complete search history.

(56) References Cited

U.S. PATENT DOCUMENTS

| | | | | | |
|---|---|---|---|---|---|
| 4,714,190 | A | * | 12/1987 | Morrocco | B65D 81/3851 220/315 |
| 4,718,595 | A | * | 1/1988 | Jones | B65D 5/18 229/117.03 |
| 4,723,700 | A | | 2/1988 | Wischusen et al. | |
| 4,915,235 | A | | 4/1990 | Roosa | |
| 4,955,528 | A | * | 9/1990 | Schluckebier | B65D 5/48002 229/120.18 |
| 5,417,364 | A | * | 5/1995 | Shaw | B65D 5/48024 229/120.02 |
| 5,626,283 | A | * | 5/1997 | Mellon | B65D 5/18 229/120.13 |
| 5,720,429 | A | | 2/1998 | Cordle | |
| 6,050,482 | A | | 4/2000 | Cai | |
| 2003/0206997 | A1 | | 11/2003 | Winkelman et al. | |
| 2006/0222271 | A1 | | 10/2006 | Yoffe | |
| 2015/0028088 | A1 | | 1/2015 | Mills et al. | |

* cited by examiner

PACKET FOR FRENCH FRIES AND A PLANO FOR ASSEMBLING SUCH PACKET

The invention relates to a packet for french fries at least comprising a bottom and side walls and having a total surface area, and provided with perforations that collectively have an open area which is set at a preselected ratio of the total surface area.

EP-B-0 867 379 discloses a bag for wrapping food, in particular bread, which is made of a composite material with at least one first layer of a cellulose containing material and a second layer of plastic, wherein the composite material is perforated and a ratio of an open area to the overall area of the composite material is set in the range from 1/50 to 1/250 (0.4-2%).

Applicant has investigated this known bag and has found that it is unsuitable as a packet for french fries, in particular because the fries do not survive an extended stay or holding time in the packets without losing their bite.

Both consumers of french fries and the sellers of such french fries place several demands on packets to be used for such french fries. These demands are at least partly in line with each other. The sellers require that the packets enable easy filling with fried/cooked or prepared fries, and that the packets in stock will not take much space. Consumers of french fries require that the fries can survive a minimum holding time in the packets without losing their crispy texture. Investigations have shown that there is a need for a packet for french fries which allows a holding time for the fries of approximately 20 minutes, where after the fries still must be crispy and meet a so-called crunching test to determine the crispiness of the fries by chewing. Reportedly a good crispiness requires at least five times chewing wherein the fries generate crunchiness in the mouth. Furthermore the packets must enable easy transportation, and must provide easy opening, good access to the fries, etc.

DE 20 2011 051 768 U discloses a packet for french fries without a lid, but with a front wall, a backwall, and sidewalls, wherein all walls are provided with ventilation perforations.

US2015/0028088 discloses a packet for french fries and other snack products comprising a bottom, side walls, a front- and a back-wall and a closable lid, which packet has a total surface area and is provided with perforations that collectively have an open area which is set at a preselected ratio of the total surface area, wherein said perforations are at least provided in the lid. In some embodiments disclosed in this citation the perforations are also provided in the sidewalls.

It is an object of the invention to improve the known packet so that it better meets at least in part one or more of the above demands, and to gain further advantages as will become apparent from the following disclosure.

The packet of the invention is provided with several features which will be discussed herein cumulatively, however it is to be understood that each feature as embodied in the appended claims can be applied independent from any of the other features in the other claims and be made part of a divisional application without need to incorporate any of said other features of the other claims.

Furthermore the invention is not only embodied in a packet for french fries, but also in a one-piece plano from which such a packet for french fries can be manufactured. Also with regard to the piano it is to be understood that each feature as embodied in the appended claims can be applied independent from any of the other features in the other claims and be made part of a divisional application without need to incorporate any of said other features of the other claims.

Such a one-piece plano is particularly useful for sellers of french fries that require that limited stockroom will be necessary to keep the packaging material for the fries in stock. In order to meet also other demands that are placed on the packets for french fries, it is preferred that the plano comprises a connecting member that connects on opposite sides of said member to a first side member and to a second side member. The connecting member can be essentially rectangular or round, i.e. circular, elliptical or oval. When assembling the packet out of the piano it is then possible to convert the first and second side member into the front- and back-wall of the packet and the connecting member into the bottom of the packet. The bottom is preferably concave for reasons to be explained hereinafter, and the first and second side member can be essentially convex or rounded at its exterior. This corresponds to preferable features of the packet of the invention, i.e. that the packet is capable of freestanding, and that the front- and back-wall smoothly convert into each other so as to provide the packet with a substantially convex or rounded exterior. This rounded exterior enables easy handling of the packet. Depending on circumstances it is however also feasible that the packet will be given a more rectangular appearance, without losing its ease of handling.

Another desirable feature of the plano is that the first and the second side member are each tapering with an increasing width with increasing distance from the connecting member, wherein said width is measured perpendicularly to a body axis extending through the first and second side member and the connecting member. This enables that when the packet is assembled from the plano, the front- and back-wall taper away from each other when looked from the bottom upwards, which promotes that the packets can be easily filled with fried/cooked or prepared fries. It also enables easy placement of the packet with the fries in a cup holder of a car. Furthermore taking fries from the packet of the invention is promoted by the larger dimensions of the packet facing upwards.

Perhaps most important from a consumer point of view is the capability of the packet for the fries to conserve their crispiness for an extended duration, enabling transportation of the fries from their point of sale to a location where the fries are consumed. As is mentioned above it is desirable to allow a holding time of approximately 20 minutes of the fries in the packet, and save their capability to pass an organoleptic crispiness test in which crunching should be experienced during at least five times chewing of the fries. For that and other purposes of the invention the packet and the plano from which it is preferably made are provided with the features of one or more of the appended claims.

It is particularly preferable that in the packet of the invention the perforations are not only provided in the lid but are also provided in the front and back-wall. This has proven to provide superior results in comparison with the known packets that are provided with perforations.

Preferably the packet has a total surface area, and is provided with perforations that collectively have an open area which is set at a preselected ratio of the total surface area, which is set in the range of 3-10%. This enables that evaporated moisture from the fries can escape from the packet therewith avoiding that the fries will get soggy and limp and lose their crispiness. The ratio can for instance be set at a value of 3.2% for generally satisfactory results, however the preferred value of this ratio depends on the situation according to which the packet is transported and should be smaller when the packet is transported in an open bag, and larger when the packet is transported in a closed casing.

Preferably the bottom of the packet is concave so that the fries in the packet are prevented from piling up on each other without leaving any room between them, which would prevent that moisture can escape from the piled up fries. In this manner it is promoted that also the most inner fries in the packet will remain crispy.

It is remarked that the perforations in the lid can also be embodied as openings next to the lid. The perforations in the lid or said openings next to the lid provide a chimney effect to the packet further promoting the escape of evaporated moisture of the fries out of the packet.

Preferably the perforations in the front- and back-wall are restricted to an area in the bottom's vicinity. In practice this means that the bottom's vicinity preferably extends from the bottom up to approximately a third of the total height of the front- and back-wall. Some variation is however possible wherein the perforations extend beyond said third of the total height of the front- and back-wall.

One other aspect is that the open area of the perforations in the lid and/or an open area next to the lid is preferably larger than the open area of the perforations in the front- and back-wall at the bottom's vicinity. If there are perforations in the front- and back-wall in the vicinity of the lid, the functionality of these perforations adds to the perforations in the lid. This enables that sufficient moisture can escape from the packet, keeping in mind that the dimensions of the perforations in the front- and back-wall cannot be chosen too large if losing fries from the packet is to be avoided. Fries come in two sizes: 6×6 mm and 9×9 mm, so the dimensions of the perforations must be selected keeping these sizes in mind.

The invention will hereinafter be further elucidated with reference to the drawing of an exemplary embodiment of an packet and a plano according to the invention that is not limiting as to the appended claims.

Figure 8:
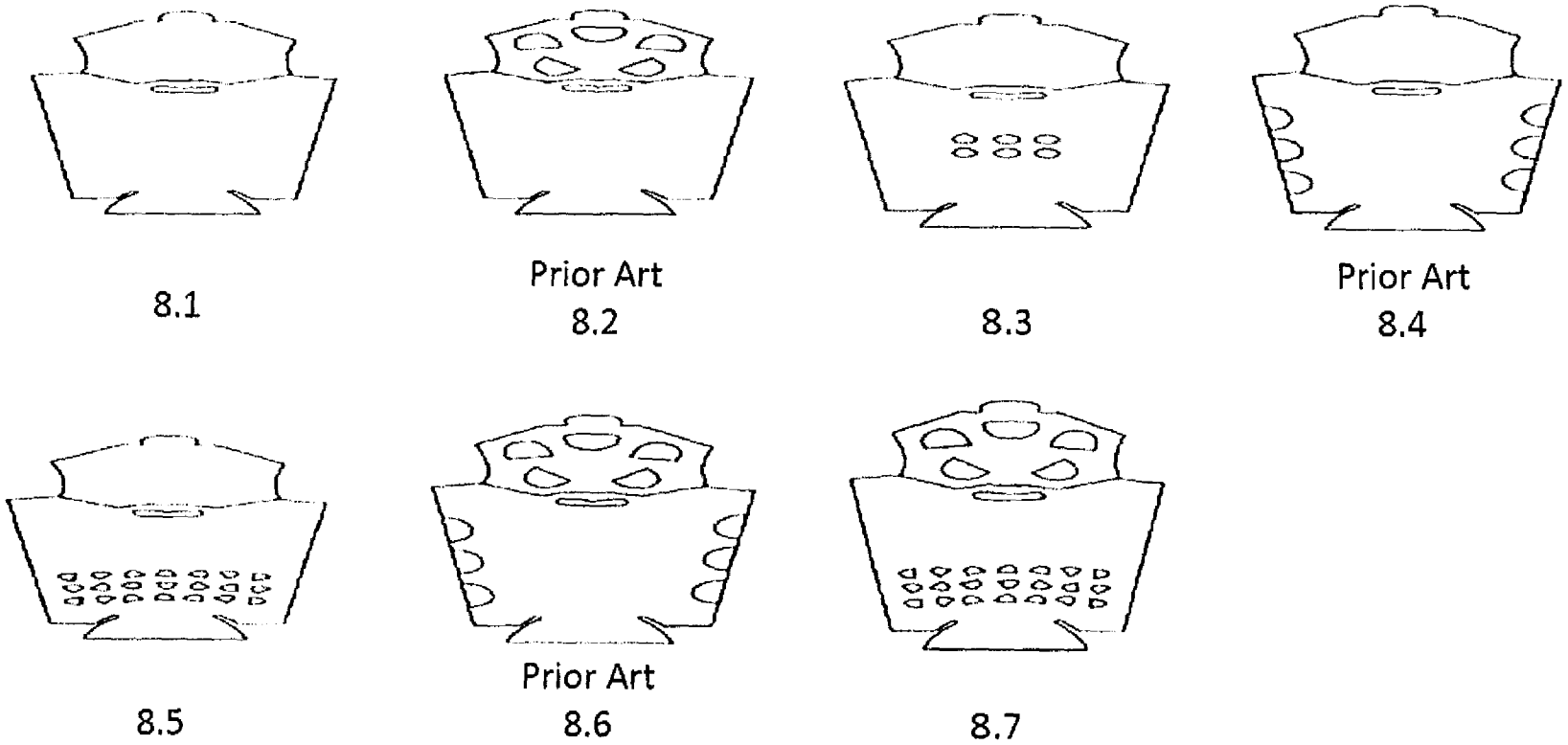
Figure 9:
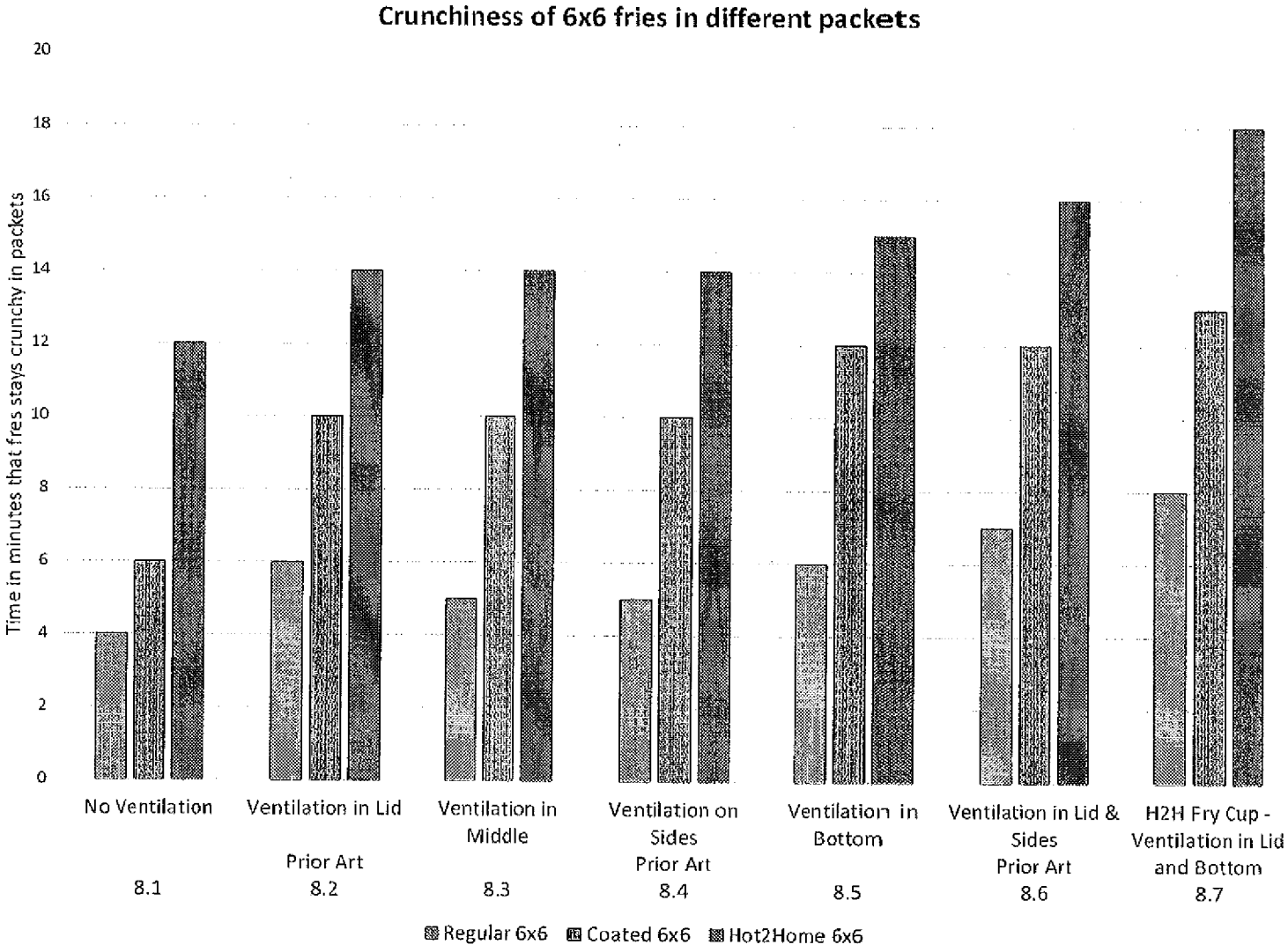
Figure 10:
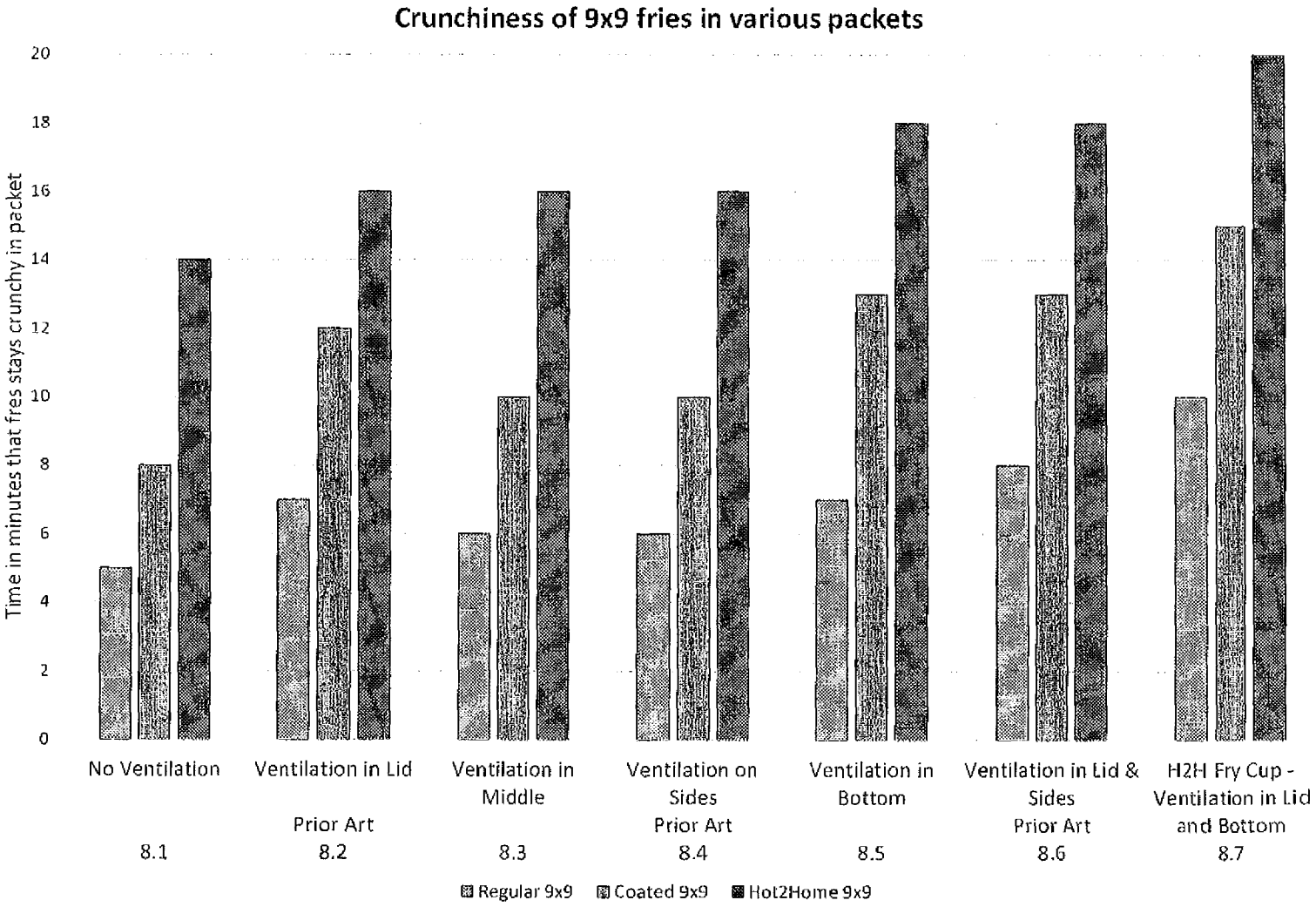

FIG. 8 schematically shows seven samples of packets that have been comparatively investigated in a crunchiness test on different qualities of fries packed in these packets;

FIG. 9 shows the results of the crunchiness test for each packet-sample as applied with three different qualities of fries in the size 6×6; and FIG. 10 shows the results of the crunchiness test for each packet-sample applied with three different qualities of fries in the size 9×9.

Whenever in the figures the same reference numerals are applied, these numerals refer to the same parts.

In a comparative testing on the duration of maintaining crunchiness of french fries packed in different types of packets, the packet of the invention has been compared with packets with perforations in different varieties, as will be discussed hereinafter. First however the plano and the packet of the invention will be discussed. Making reference to FIG. 1 a one-piece plano 1 is shown for a packet for french fries, which comprises an essentially circular connecting member 2 that connects on opposite sides of said member 2 to a first side member 3 and a second side member 4. It is to be understood however that the connecting member 2 can also be elliptical or oval, or even rectangular. The first side member 3 and the second side member 4 are each tapering with an increasing width with increasing distance from the connecting member 2, wherein said width is measured perpendicularly to a body axis 5 extending through the first and second side member 3, 4 and the connecting member 2.

Figure 1:
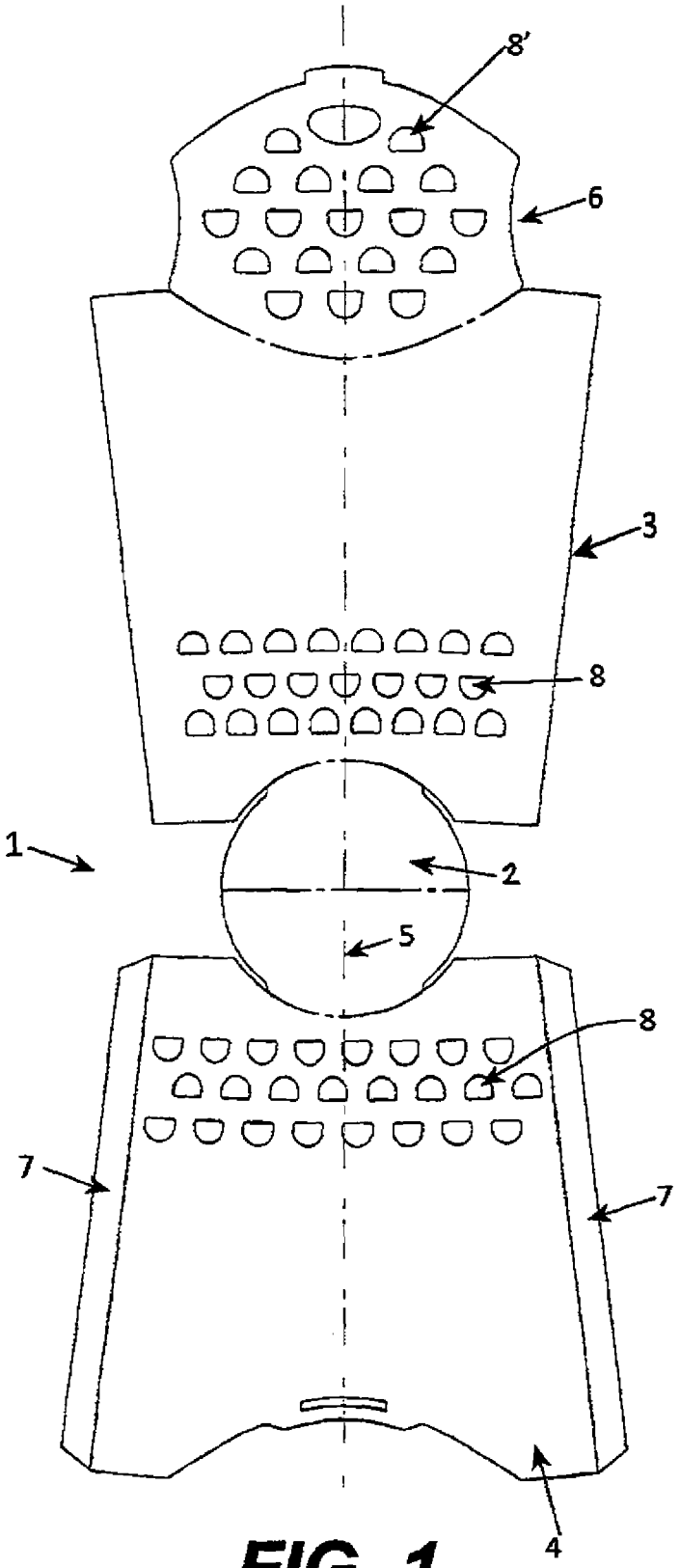
FIG. 1 shows a plano for a packet for french fries according to the invention.

FIG. 1 also shows that the first side member 3 connects to an extension piece 6 which is embodied to serve as a lid in a configuration of the plano wherein it is assembled into a packet as shown in the FIGS. 2-7 to be discussed hereinafter. Obviously the extension piece 6 could instead of being provided to the first side member 3, also be provided as an extension to the second side member 4. It is of course also possible that the extension piece 6 is split in half, wherein each one of the side members 3, 4 connects to one of the halves.

In the shown embodiment of FIG. 1 the second side member 4 is provided with a rim or rims 7 for connecting to the first side member 3 when it is assembled into the packet of the invention shown in FIGS. 2-7. It will however be clear for the artisan that the rim or rims can also be provided on the first side member 3 for connecting to the second side member 4, or that both members 3, 4 may have such a rim for connecting to the other member. Said rims 7 may eventually form sidewalls of the ready packet.

FIG. 1 further shows that the first side member 3, the second side member 4 and the extension piece 6 are provided with perforations 8, 8'. It is however feasible that not each member 3, 4 is provided with perforations 8, although the extension piece 6 is always provided with perforations 8'. Optimal results are achieved in the embodiment as shown in FIG. 1. It is preferred that the open area of the perforations 8 in the first side member 3 and/or the second side member 4 is smaller than the open area of the perforations 8' in the extension piece 6. Consequently in the packet of the invention made from this plano as for instance shown in FIG. 6 the open surface area created by the perforations 8 in the front- and back-wall 12 will be smaller than the open surface area of the lid 13, including any openings 8" at the sides near to the lid 13 that add to the functionality of the openings 8' in the lid 13. In practice it is preferred that the perforations 8 in the first member 3 and/or the second member 4 prevent passing of fries with sizes 6×6 mm and/or 9×9 mm.

It can further be inferred from FIG. 1 that the perforations 8 in the first member 3 and/or the second member 4 are provided in a region spanning a maximum of one third of said members' length, which region is adjacent to the connecting member 2. All in all it is advantageous for the achievements of the packet of the invention shown in FIGS. 2-7 that the plano 1 has a total surface area and is provided with perforations 8, 8' that collectively have an open area, wherein a ratio of the open area and the total surface area is set in the range of 3-10%.

Figure 2:
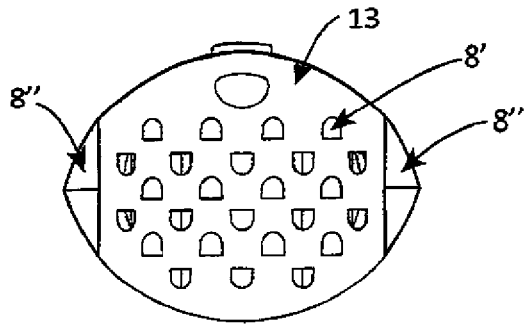
FIG. 2 shows a top view of the packet for french fries according to the invention with closed lid.
Figure 4:
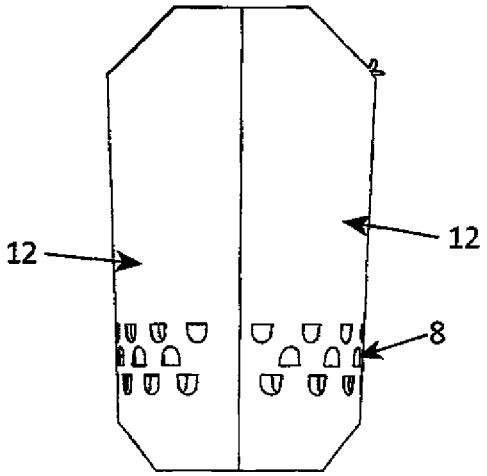
Figure 5:
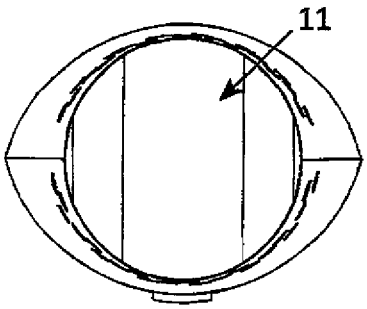
FIG. 5 shows a bottom view of the packet for french fries according to the invention.
Figure 6:
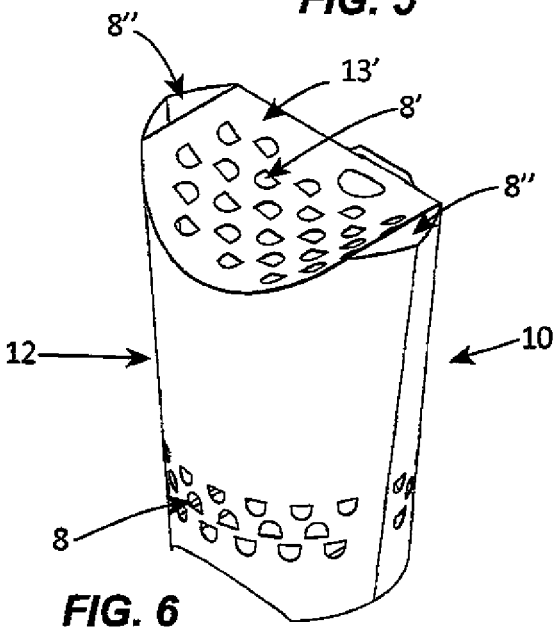
FIG. 6 shows an isometric view of the packet for french fries according to the invention with closed lid.

Turning now to FIG. 6 a packet 10 for french fries according to the invention is shown in isometric view, which packet 10 is manufactured from a plano 1 as shown in FIG. 1, and which comprises a bottom 11 as shown in FIG. 5, and front- and back-walls 12 connected to each other with sidewalls as can be best seen in FIG. 4. The packet 10 measures to a total surface area, and is provided with perforations 8, 8' that collectively have an open area which is set at a preselected ratio of said total surface area, which is set in the range of 3-10%. FIG. 6 also shows that apart from the perforations that are provided in the front- and back-wall 12, the packet 10 has a closable lid 13 as also shown in FIG. 2, wherein perforations 8' are also provided in said lid 13. Further there may be openings 8" next to the lid 13 with the same functionality as the perforations 8' in the lid 13.

Figure 7:
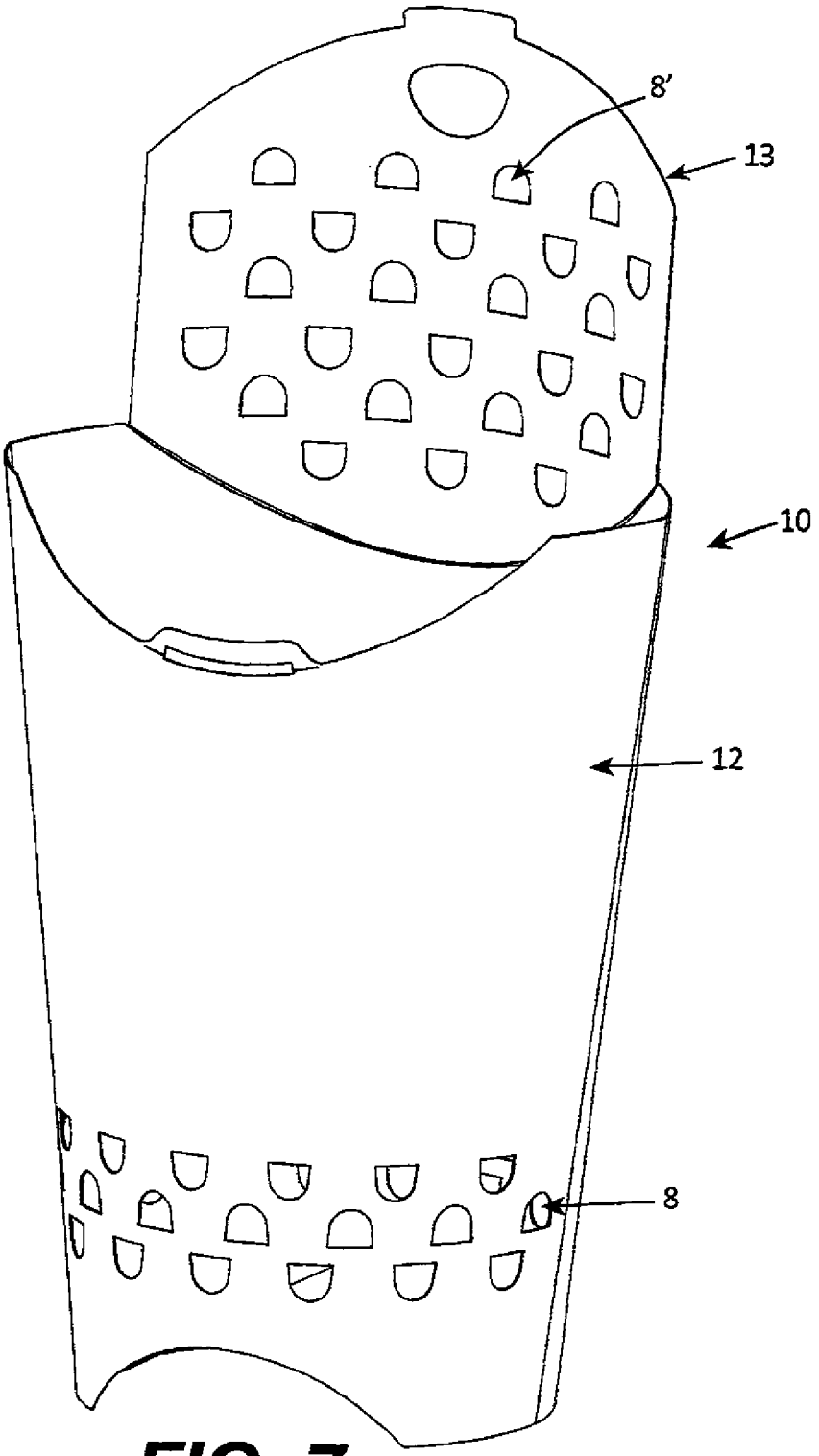
FIG. 7 shows the packet of FIG. 6 with open lid.

FIG. 6 and FIG. 7 both show that the packet 10 is capable of freestanding and that the perforations 8 in the front- and back-wall 12 are restricted to an area in the vicinity of the bottom 11. It can be derived from these figures that the bottom's vicinity extends from the bottom 11 up to approximately a third of the front- and back-wall's total height. In FIG. 7 the packet 10 of the invention is shown with open lid 13, as opposed to FIG. 6 in which the packet 10 of the invention is shown with closed lid 13.

According to the invention it is preferred that the open area of the perforations 8' in the lid 13 and/or the openings 8" next to the lid 13 is larger than the open area of the perforations 8 in the side walls 12 at the bottom's vicinity.

Preferably the perforations 8 in the front- and back-wall 12 are provided with dimensions to prevent passing of fries with sizes 6×6 mm and/or 9×9 mm.

Figure 3:
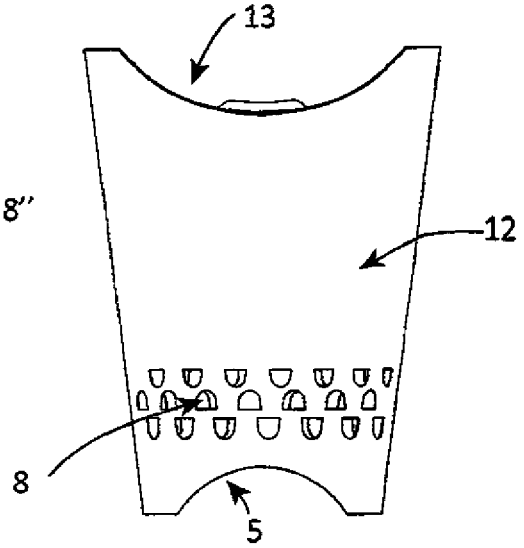
FIGS. 3 and 4 show side views of the packet for french fries according to the invention.

FIGS. 3, 5 and 7 show that it is preferable that the bottom 11 of the packet is concave so as to prevent that the fries in the packet are piling up on each other without leaving any room between them, which would hinder or even prevent the escape of moisture from the piled up fries in the packet.

It can be best seen from the side view of FIG. 3, but also from FIG. 6 that the front- and back-wall 12 taper away from each other when looked from the bottom 11 upwards. The combination of FIG. 4 with FIG. 6 shows that the front- and back-wall 12 smoothly convert into each other so as to provide the packet 10 with a substantially rounded exterior, particularly at the sidewalls connecting the front- and back-wall 12. Finally it is remarked that the packet 10 of the invention is preferably made out of one piece of material, such as the plano 1 of FIG. 1.

The beneficial results of the invention will hereinafter be further discussed in the following discussion of a comparative investigation concerning the duration that crunchiness of french fries of three different qualities is maintained depending on the type of packet used for holding the fries. The investigated packets are shown schematically in FIG. 8, wherein;

- 8.1 depicts a standard packet without any perforations;
- 8.2 depicts a packet with perforations only in the lid (as known from US2015/0028088);
- 8.3 depicts a packet with perforations halfway in the middle of the front- and back-wall;
- 8.4 depicts a packet with perforations in the sidewalls only (as known from US2015/0028088);
- 8.5 depicts a packet with perforations in the bottom region of the front- and back-wall;
- 8.6 depicts a packet with perforations in the lid and in the sidewalls (as known from US2015/0028088); and
- 8.7 depicts a packet with perforations provided in the lid and in the front- and back-wall in accordance with the invention.

FIGS. 9 and 10 show histograms corresponding with the time duration that crunchiness of three different qualities of french fries are maintained in the tested packets, for each of the mentioned packets shown in FIG. 8. FIGS. 9 and 10 refer to the tested packets by the packet indications 8.1-8.7. In FIG. 9 the results are shown with 6×6 fries, whereas in FIG. 10 the results are shown with 9×9 fries. The qualities of fries that are investigated are regular fries, coated fries, and a top-notch hot development of superior fries that the applicant contemplates to market as Hot2Home™ fries.

The results collected in FIGS. 9 and 10 respectively for 6×6 and 9×9 fries consistently show that best results are achieved with any type of fries when packet 8.7 is used which is embodied in accordance with the features of the invention as discussed hereinabove and specified in the appended claims.

Although the invention has been discussed in the foregoing with reference to an exemplary embodiment of the packet and the plano of the invention, the invention is not restricted thereto and can be varied in many ways without departing from the invention. The discussed exemplary embodiment of the packet and plano shall therefore not be used to construe the appended claims strictly in accordance therewith. On the contrary the shown embodiment of the packet and plano are merely intended to explain the wording of the appended claims without intent to limit the claims thereto. The scope of protection of the invention shall therefore be construed in accordance with the appended claims only, wherein a possible ambiguity in the wording of the claims shall be resolved using this exemplary embodiment of the packet and plano.

The invention claimed is:

1. A packet for french fries having a surface area, the packet comprising:

a bottom, sidewalls, a front wall, a backwall, a lid, and perforations, wherein the perforations collectively have an area at a preselected ratio of the surface area of the packet, wherein the perforations are at least provided in the lid, the front wall, and the backwall, wherein the perforations in the front wall and the backwall are substantially restricted to an area that extends from the bottom up to about one-third of a total height of the front wall and back wall.

2. The packet of claim 1, wherein the preselected ratio is in the range from about 3% to about 10%.

3. The packet of claim 1, wherein the perforations are at least in part embodied as openings next to the lid.

4. The packet of claim 1, wherein the bottom is concave.

5. The packet of claim 1, further comprising at least one member of a group consisting of: an open area in the lid is larger than an open area of perforations in the front wall and back wall, and an open area of perforations in the openings next to the lid is larger than an open area of perforations in the front wall and backwall.

6. The packet of claim 1, wherein the perforations in the front wall and the backwall have dimensions to prevent passing of fries through the perforations.

7. The packet of claim 1, wherein the front wall and the backwall taper outwardly from the bottom to the lid.

8. The packet of claim 1, wherein the packet is made from one piece of material.

9. The packet of claim 1, wherein the packet is made from a plano.

10. A one-piece plano for a packet of french fries, comprising:

a connecting member that connects on opposite sides of the connecting member to first and second side members, wherein the first and the second side members are each tapered with an increasing width from the connecting member; and an extension piece which is embodied as a lid, wherein one of the first and second side members connects to the extension piece, wherein the first side member, the second side member and the extension piece are provided with perforations, wherein the perforations in the first side member and the second side member are provided in a region spanning about one-third a length of the first side member and the second side member and is adjacent to the connecting member.

11. The one-piece plano of claim 10, wherein the perforations in the front wall and the backwall have dimensions to prevent passing of fries through the perforations.

12. The one-piece plano of claim 10, further comprising at least one member of a group consisting of: an open area provided by the perforations in the first side member is smaller than an open area of the perforations in the extension piece, and an open area provided by the perforations in the second side member is smaller than an open area of the perforations in the extension piece.

13. The one-piece plano of claim 10, wherein the plano has a surface area and the perforations have a collective open area, wherein the ratio of the open area and the surface area is in the range of about 3% to about 10%.

* * * * *